US010918212B2

(12) United States Patent
Lim

(10) Patent No.: US 10,918,212 B2
(45) Date of Patent: Feb. 16, 2021

(54) HEATING CHAIR USING CARBON FIBER HEATING ELEMENT HAVING MULTI-LAYERED THERMAL LAYER

(71) Applicants: KOREA CITY TRAFFIC SYSTEM, Jeollabuk-do (KR); PITCHCABLE CO., LTD., Jeollabuk-do (KR)

(72) Inventor: Dong Wook Lim, Jeonju-si (KR)

(73) Assignees: UNION CITY CO., LTD., Jeonju-si (KR); PITCHCABLE Co., Ltd., Jeonju-si (KR)

( * ) Notice: Subject to any disclaimer, the term of this patent is extended or adjusted under 35 U.S.C. 154(b) by 217 days.

(21) Appl. No.: 16/085,922

(22) PCT Filed: Jan. 31, 2017

(86) PCT No.: PCT/KR2017/001004
§ 371 (c)(1),
(2) Date: Sep. 17, 2018

(87) PCT Pub. No.: WO2017/135646
PCT Pub. Date: Aug. 10, 2017

(65) Prior Publication Data

US 2019/0099004 A1 Apr. 4, 2019

(30) Foreign Application Priority Data

Feb. 1, 2016 (KR) ..... 10-2016-0012213

(51) Int. Cl.
*A47C 7/74* (2006.01)
*A47C 11/00* (2006.01)
(Continued)

(52) U.S. Cl.
CPC ..... *A47C 7/748* (2013.01); *A47C 7/02* (2013.01); *A47C 11/00* (2013.01); *H05B 3/14* (2013.01);
(Continued)

(58) Field of Classification Search
None
See application file for complete search history.

(56) References Cited

U.S. PATENT DOCUMENTS 5,176,424 A * 1/1993 Tobita ..... A47C 27/082 297/284.1
5,484,983 A * 1/1996 Roell ..... D04B 1/12 219/528
(Continued)

FOREIGN PATENT DOCUMENTS

JP 3013484 U 7/1995
JP 2000-201774 A 7/2000
(Continued)

OTHER PUBLICATIONS

International Search Report issued in PCT/KR2017/001004; dated Apr. 26, 2017.
(Continued)

*Primary Examiner* — Ibrahime A Abraham
*Assistant Examiner* — Gyounghyun Bae
(74) *Attorney, Agent, or Firm* — Studebaker & Brackett PC

(57) ABSTRACT

The present disclosure relates to a heating chair including: a chair having a mounting groove of a predetermined depth on an upper surface of a seat; a thermal pad mounted in the mounting groove of the seat; a carbon fiber heating element provided on an upper surface of the thermal pad so as to emit heat by the application of power; a heating plate provided on an upper side of the carbon fiber heating element so as to be heated by the carbon fiber heating element; a conductive cover plate having a floating structure and covered on an upper side of the heating plate so as to form a thermal air layer between the heating plate and the conductive cover plate; and a finishing silicon finishing the edges of the
(Continued)

mounting groove of the seat such that the thermal air layer is sealed.

5 Claims, 9 Drawing Sheets

(51) Int. Cl.
*A47C 7/02* (2006.01)
*H05B 3/14* (2006.01)
*H05B 3/20* (2006.01)
*H05B 3/54* (2006.01)

(52) U.S. Cl.
CPC ..... *H05B 3/145* (2013.01); *H05B 3/20* (2013.01); *H05B 3/54* (2013.01); *H05B 2203/029* (2013.01)

(56) References Cited

U.S. PATENT DOCUMENTS 8,864,221 B1* 10/2014 Delvilla ..... A47C 7/021 297/31
2006/0158011 A1* 7/2006 Marlovits ..... A47C 7/02 297/180.1
2006/0175877 A1* 8/2006 Alionte ..... B60N 2/5635 297/180.14
2007/0056957 A1* 3/2007 Diemer ..... B64D 15/12 219/549
2008/0073130 A1 3/2008 Bulgajewski et al.
2008/0182071 A1* 7/2008 Cheng ..... A47C 7/748 428/138
2009/0033130 A1* 2/2009 Marquette ..... B60N 2/5657 297/180.15
2010/0129575 A1* 5/2010 Veiga ..... D06N 3/183 428/35.4
2012/0313405 A1* 12/2012 Eckman ..... A47C 7/748 297/180.12
2013/0221642 A1* 8/2013 Arnold ..... B60R 21/18 280/733
2015/0257205 A1* 9/2015 Hase ..... H05B 3/20 219/539

FOREIGN PATENT DOCUMENTS

KR 20-0278864 Y1 6/2002
KR 20120005790 U 8/2012
KR 20-2013-0006324 U 11/2013
KR 10-1390655 B1 5/2014
KR 101481382 B1 1/2015
KR 10-1528798 B1 6/2015

OTHER PUBLICATIONS

Extended European Search Report issued by the European Patent Office dated Nov. 6, 2018, which corresponds to EP17747691.8-1204 and is related to U.S. Appl. No. 16/085,922.

* cited by examiner

HEATING CHAIR USING CARBON FIBER HEATING ELEMENT HAVING MULTI-LAYERED THERMAL LAYER

CROSS REFERENCE TO RELATED APPLICATION

The present application is a National Phase application of International Patent Application No. PCT/KR2017/001004, filed Jan. 31, 2017, which is based upon and claims the benefit of priority to Korean Patent Application No. 10-2016-0012213, filed on Feb. 1, 2016. The disclosure of the above-listed applications is hereby incorporated by reference herein in its entirety.

TECHNICAL FIELD

The present inventive concept relates to a heating chair using a carbon fiber heating element, and more particularly, to a heating chair using a carbon fiber heating element having a multi-layered thermal layer, in which a multi-layered thermal air layer is formed as a floating structure between a heating plate heated by a planar or linear carbon fiber heating element and a conductive cover plate covering an upper side of the heating plate in order to prevent waste of power due to heat loss.

BACKGROUND ART

Generally, a conventional electric heater uses 220 V or 110 V at home and tides a resistance wire, such as a copper wire or a nichrome wire, as a heating element. The conventional electric heater generates heat by causing an electric current to flow through the resistance wire placed and fixed in a zigzag manner.

However, the conventional electric heater can be manufactured only in the form of a mat due to a structural problem, and it is difficult to manufacture the electric heater in a specific form for special use. In addition, if the conventional electric heater is used fora long time, the resistance wire such as the copper wire or the nichrome wire is easily broken. To repair this, product has to be disassembled to reconnect or replace the broken wire.

Furthermore, the conventional electric heater using the resistance wire such as the copper wire or the nichrome wire can cause a fire or burns due to overheating and can adversely affect the human body by generating electromagnetic waves.

To solve these problems of the conventional art, a heater using carbon fibers is being developed and used. The heater using the carbon fibers has a small thermal capacity and excellent rise and fall temperature characteristics as compared with a heater using a metal heating element. In addition, the heater using the carbon fibers has excellent high-temperature durability in a non-oxidizing atmosphere. Due to these advantages, the heater using the carbon fibers is gradually being applied not only to heating devices but also to drying devices.

Carbon that forms the carbon fibers described above mainly has an inorganic or organic graphite structure and may be in the forms of carbon fibers, carbon powder, cotton-like; carbon felt, solid carbon rods, etc. Due to high elasticity and strength, carbon is stronger than iron and lighter than aluminum.

Carbon fibers, which are one type of carbon as described above, are classified into polyacrylonitrile (PAN)-based carbon fibers, pitch-based carbon fibers, and rayon-based carbon fibers according to their raw material. Of these carbon fibers, the PAN-based carbon fibers and the rayon-based carbon fibers are the most common carbon fibers.

Of the carbon fibers described above, the PAN-based carbon fibers are produced by baking PAN in an inert gas at a temperature of 1,000 to 2,000° C. or higher. On the other hand, the pitch-based carbon fibers are produced by converting pitch from coal into a fibrous form and then performing almost the same process on the pitch as the process performed on the PAN. However, since the pitch-based carbon fibers are cheaper than the PAN-based carbon fibers, they are widely used as a high-temperature insulator or a stiffener.

In a conventional planar heating element using carbon fibers, a carbon fiber heating; wire is generally woven directly into a fabric. Therefore, the conventional planar heating element using the carbon fibers is not great in its heating effect and has a risk of fire.

In addition, in the conventional planar heating element using the carbon fibers, the carbon fibers are easily broken.

Also, there are many difficulties in applying the conventional heating element using the carbon fibers to a chair at a bus station or in a park.

DISCLOSURE

Technical Problem

The inventive concept has been made to solve the foregoing problems of the conventional art and therefore an objective of the inventive concept is to provide a heating chair using a carbon fiber heating element having a multi-layered thermal layer, in which a multi-layered thermal air layer is formed as a floating structure between a heating plate heated by a planar or linear carbon fiber heating element and a conductive cover plate covering an upper side of the heating plate in order to reduce heat loss.

In addition, it is another objective of the technology according to the inventive concept to save energy by reducing heat loss through a structure in which a multi-layered thermal air layer is formed as a floating structure between a heating plate heated by a planar or linear carbon fiber heating element and a conductive cover plate covering an upper side of the heating plate.

Furthermore, it is another objective of the technology according to the inventive concept to provide a comfortable environment to a user by making the heat of a heating plate be more quickly conducted to a conductive cover plate when the weight of the user is put on the conductive cover plate through a structure in which a multi-layered thermal air layer is formed as a floating structure between the heating plate heated by a planar or linear carbon fiber heating element and the conductive cover plate covering an upper side of the heating plate.

Technical Solution

To achieve the above objectives, the inventive concept is configured as follows. That is, a heating chair using a carbon fiber heating element having a multi-layered thermal layer according to the inventive concept includes: a chair which in ailed at a bus station or a railway station or in a park and has a mounting groove of a predetermined depth on an upper surface of a seat; a thermal pad which is mounted on the mounting groove of the seat; the carbon fiber heating element which is installed on an upper surface of the thermal pad and generates heat when supplied with power; a heating plate which is installed on an upper side of the carbon fiber heating element and heated by the carbon fiber heating element; a conductive cover plate which covers an upper side of the heating plate in a floating structure to form the thermal air layer between the heating plate and the conductive cover plate; a finishing silicon which closes edges of the mount groove of the seat to seal the thermal air layer; and one or more inner conductive cover plates which are installed in the thermal air layer between the heating plate and the conductive cover plate to cover the upper side of the heating plate and to horizontally divide the thermal air layer into multiple layers.

In the above-described configuration according to the inventive concept, through holes may be further formed at regular intervals in each of the inner conductive cover plates to vertically pass through each of the inner conductive cover plates.

In the above-described configuration according to the inventive concept, the carbon fiber heating element may be a planar or linear heating element.

In addition, in the above-described configuration according to the inventive concept, the thermal air layer may be sealed by the finishing silicon to elastically support the conductive cover plate through an air cushion function.

In the configuration according to the inventive concept, each of the conductive cover plate and the inner conductive cover plates may include a bending line which is formed to a predetermined length at a longitudinal center and each of the conductive cover plate and the inner conductive cover plates slopes downward from a central portion toward the bending line to form a floating structure between the heating plate and each of the conductive cover plate and the inner conductive cover plates.

In the above-described configuration according to the inventive concept, a diagonal bending line may be further formed from each corner of each of the conductive cover plate and the inner conductive cover plates to an end of the bending line.

Advantageous Effects

According to the technology of the inventive concept, it is possible to reduce heat loss through a structure in which a multi-layered thermal air layer is formed as a floating structure between a heating plate heated by a planar or linear carbon fiber heating element and a conductive cover plate covering an upper side of the heating plate.

According to the technology of the inventive concept, it is also possible to save energy by reducing heat loss through a structure in which a multi-layered thermal air layer is formed as a floating structure between a heating plate heated by a planar or linear carbon fiber heating element and a conductive cover plate covering an upper side of the heating plate.

According to the technology of the inventive concept, it is also possible to make the heat of a heating plate be more quickly conducted to a conductive cover plate when the weight of a user is put on the conductive cover plate through a structure in which a multi-layered thermal air layer is formed as a floating structure between the heating plate heated by a planar or linear carbon fiber heating element and the conductive cover plate covering an upper side of the heating plate. Therefore, a comfortable environment can be provided to the user.

MODE FOR INVENTION

Hereinafter, heating chairs using a carbon fiber heating element having a multi-layered thermal layer according to embodiments of the inventive concept will be described in detail with reference to the accompanying drawings.

Figure 1:
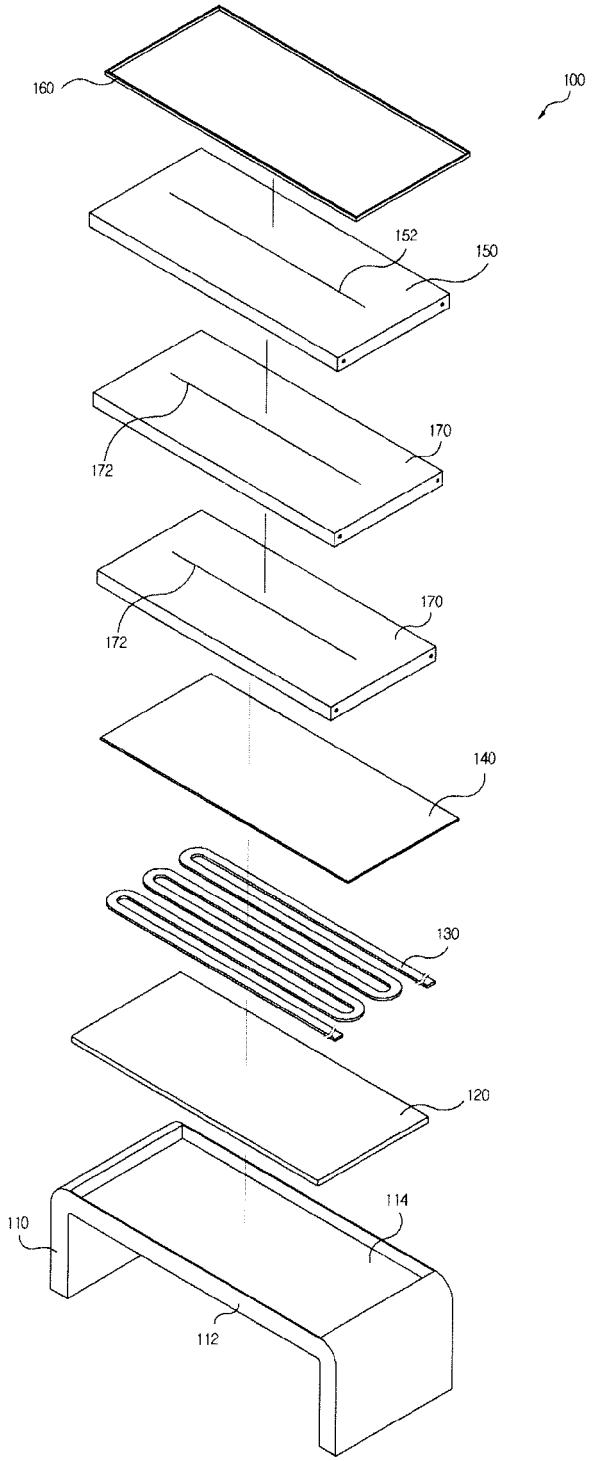
FIG. 1 is an exploded perspective view of a heating chair using a carbon fiber heating element having a multi-layered thermal layer according to the inventive concept.
Figure 2:
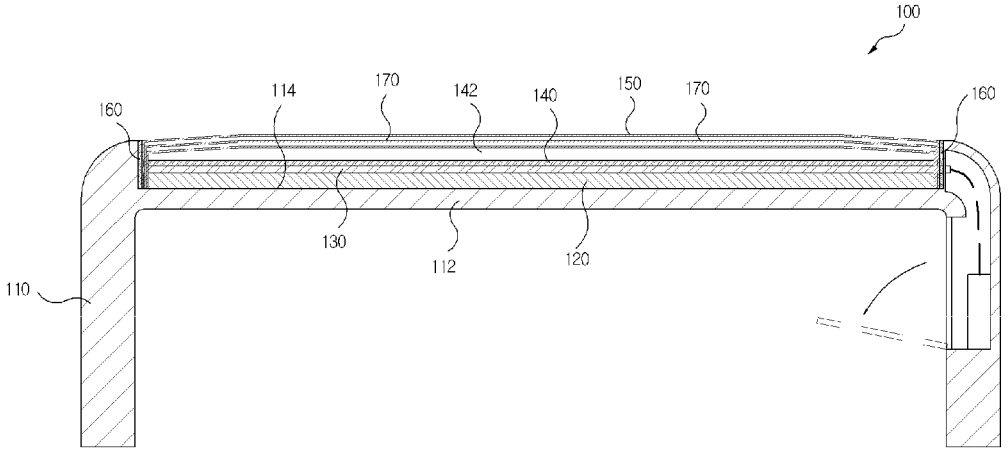
FIG. 2 is a front cross-sectional view of the heating chair using the carbon fiber heating element having the multi-layered thermal layer according to the inventive concept.
Figure 3:
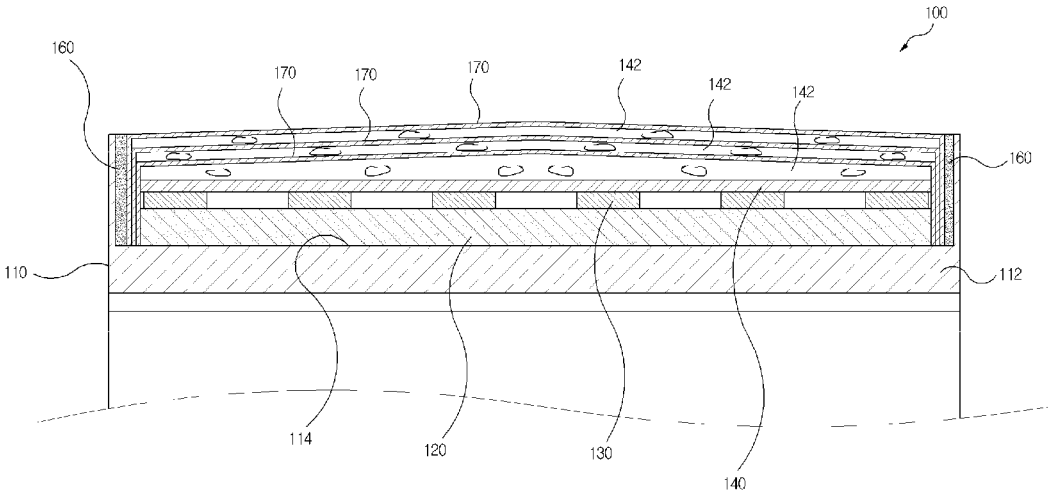
FIG. 3 is a side cross-sectional view of the heating chair using the carbon fiber heating element having the multi-layered thermal layer according to the inventive concept.
Figure 4:
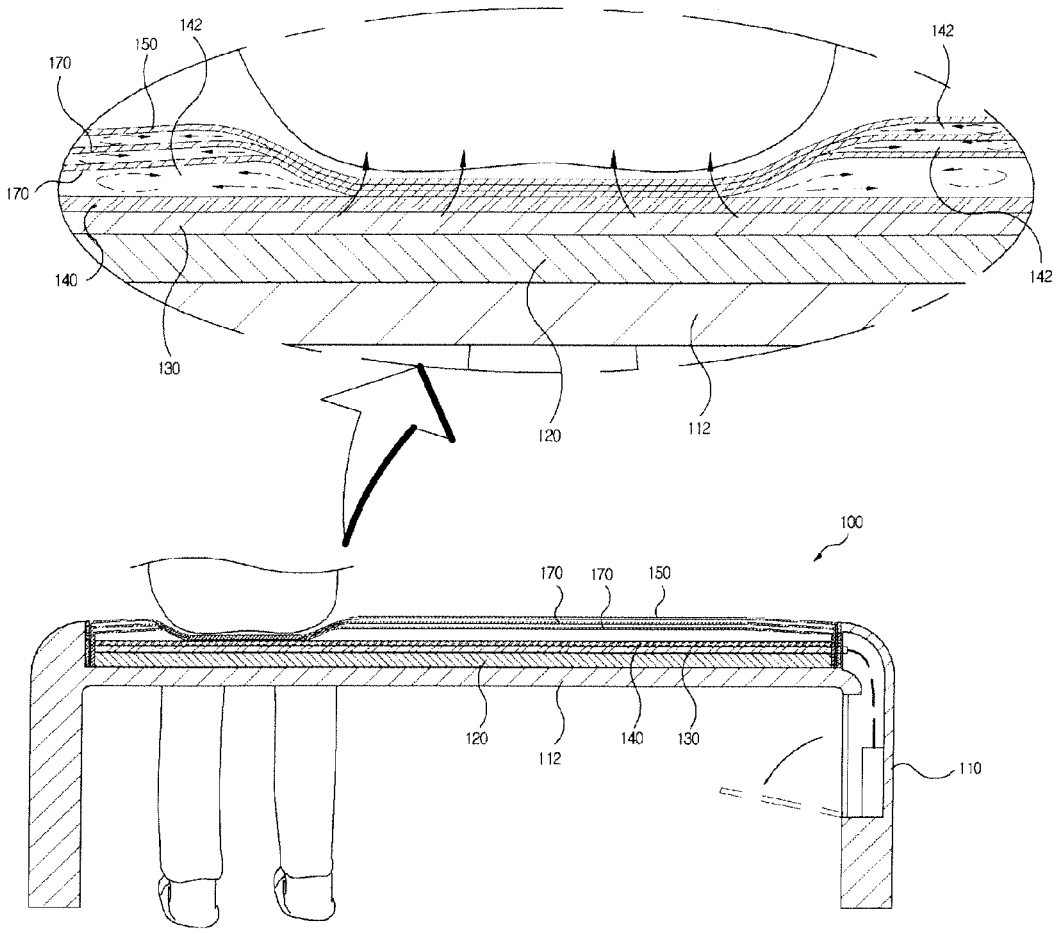
FIGS. 4 and 5 are front cross-sectional views showing an example of utilizing the heating chair using the carbon fiber heating element having the multi-layered thermal layer according to the inventive concept.
Figure 5:
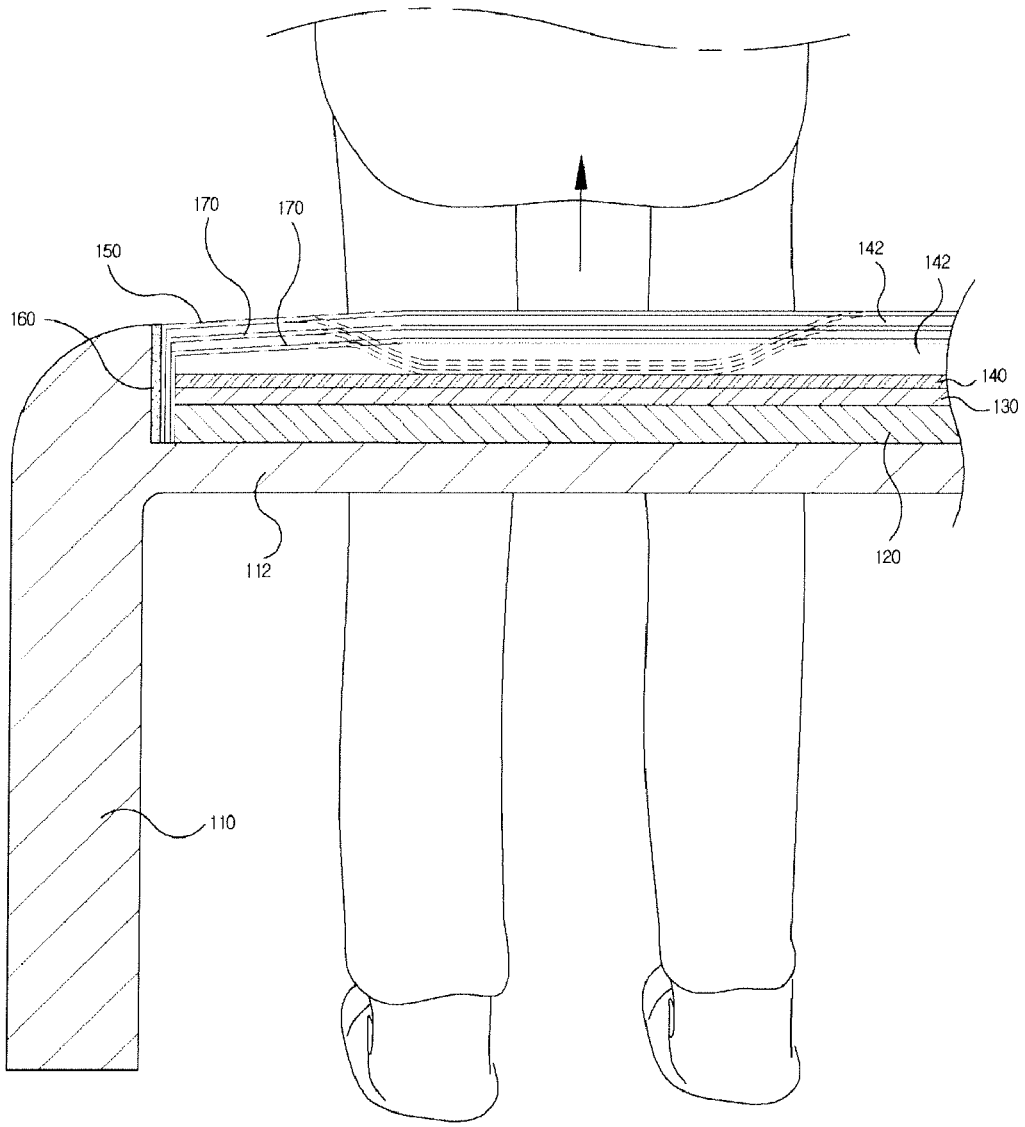

FIG. 1 is an exploded perspective view of a heating chair using a carbon fiber heating element having a multi-layered thermal layer according to the inventive concept. FIG. 2 is a front cross-sectional view of the heating chair using the carbon fiber heating element having the multi-layered thermal layer according to the inventive concept. FIG. 3 is a side cross-sectional view of the heating chair using the carbon fiber heating element having the multi-layered thermal layer according to the inventive concept. FIGS. 4 and 5 are front cross-sectional views showing an example of utilizing the heating chair using the carbon fiber heating element having the multi-layered thermal layer according to the inventive concept.

Referring to FIGS. 1 through 5, the heating chair 100 using the carbon fiber heating element having the multi-layered thermal layer according to the inventive concept is installed in a seat 112 of a chair provided at a bus station, a subway platform, a park, etc. The heating chair 100 is heated by the supply of power to provide comfort in winter.

The above-described heating chair 100 according to the inventive concept includes a chair 110 which is installed at a bus station or a railway station or in a park and has a mounting groove 114 of a predetermined depth on an upper surface of the seat 112; a thermal pad 120 which is mounted on the mounting groove 114 of the seat 112; a carbon fiber heating element 130 which is installed on an upper surface of the thermal pad 120 and generates heat when supplied with power; a heating plate 140 which is installed on an upper side of the carbon fiber heating element 130 and heated by the carbon fiber heating element 130; a conductive cover plate 150 which covers an upper side of the heating plate 140 in a floating structure to form a thermal air layer 142 between the heating plate 140 and the conductive cover plate 150; a finishing silicon 160 which closes edges of the mounting groove 114 of the seat 112 to seal the thermal air layer 142; and one or more inner conductive cover plates 170 which are installed in the thermal air layer 142 between the heating plate 140 and the conductive cover plate 150 to cover the upper side of the heating plate 140 and to horizontally divide the thermal air layer 142 into multiple layers.

In other words, the heating chair 100 according to the inventive concept includes one or more inner conductive cover plates 170 installed in a floating structure in the thermal air layer 142 between the heating plate 140 and the conductive cover plate 150 and on the upper side of the heating plate 140. Accordingly, the thermal air layer 142 is divided into multiple layers, which can facilitate heat conduction and reduce heat loss.

In the heating chair 100 according to the inventive concept configured as described above, the thermal air layer 142 formed between the heating plate 140 and the conductive cover plate 150 on the heating plate 140 and functioning as an air cushion is divided into multiple layers by the inner conductive cover plates 170. Therefore, since the heat loss of the conductive cover plate 150 is minimized by the heated air of the multi-layered thermal air layer 142, waste of power can be reduced.

Further, in the heating chair 100 according to the inventive concept described above, when the weight of a user is put on the conductive cover plate 150, the conductive cover plate 150 and the inner conductive cover plates 170 in only a portion on which the weight is put are sequentially pressed and brought into surface contact with the heating plate 140, as shown in FIG. 4. Accordingly, the heat of the heating plate 140 is conducted to the inner conductive cover plates 170 and the conductive cover plate 150. When the heating plate 140 is brought into surface contact with the inner conductive cover plates 170 and the conductive cover plate 150 as described above, the outermost conductive cover plate 150 can be heated quickly.

As described above, the conductive cover plate 150 and the inner conductive cover plates 170 in the portion on which the weight of the user is put are brought into surface contact with the heating plate 140, and thus the heat of the heating plate 140 is conducted to a hip portion of the user through the inner conductive cover plates 170 and the conductive cover plate 150. On the other hand, when the user stands up as shown in FIG. 5, the weight of the user is removed from the portion of the conductive cover plate 150 on which the user sat. In this case, the inner conductive cover plates 170 and the conductive cover plate 150 are restored to their original shape by the air cushion function of the thermal air layer 142 and the restoring force of the inner conductive cover plates 170 and the conductive cover plate 150.

The operation of the heating chair 100 according to the inventive concept described above will be described in more detail as follows. First, when the carbon fiber heating element 130 generates heat by the supply of power, the heating plate 140 installed on the upper side of the carbon fiber heating element 130 is heated by the heat generated by the carbon fiber heating element 130. When the heating plate 140 is heated as described above, the air of the thermal air layer 142 formed between the heating plate 140 and the conductive cover plate 150 is heated. At this time, the inner conductive cover plates 170 are also heated. Thus, the air of the thermal air layer 142 can be better kept heated.

When the air of the thermal air layer 142 formed between the heating plate 140 and the conductive cover plate 150 is heated as described above, the heated air heats the conductive cover plate 150. Therefore, even if heat loss occurs in an upper surface of the conductive cover plate 150, the heated air minimizes the heat loss by continuously heating the conductive cover plate 150. Here, since the inner conductive cover plates 170 in the thermal air layer 142 are always kept heated as described above, the thermal air layer 142 can be more easily kept heated.

In the above state, if a user sits on the heating chair 100 as shown in FIG. 4, a portion of the conductive cover plate 150 that the user's hips touch may sink and press the inner conductive cover plates 170 to bring the inner conductive cover plates 170 into surface contact with the heating plate 140. Accordingly, the heat of the heating plate 140 is immediately transferred to the conductive cover plate 150 through the inner conductive cover plates 170 in surface contact with the heating plate 140, thereby warming the user's hips.

On the other hand, if the user sitting on the heating chair 100 stands up as shown in FIG. 5, the weight of the user is removed from the portion of the conductive cover plate 150 on which the user sat. In this case, the conductive cover plate 150 is restored to its original shape by the air cushion function of the thermal air layer 142 and the restoring force of the conductive cover plate 150. Here, the inner conductive cover plates 170 are also restored to their original shape by their own restoring force.

In the heating chair 100 according to the inventive concept configured as described above, the thermal pad 120 is installed on a bottom surface of the mounting groove 114 of the seat 112, and the carbon fiber heating element 130 is installed on an upper side of the thermal pad 120. Therefore, when the carbon fiber heating element 130 generates heat, heat loss through a lower side is prevented by the thermal pad 120.

Each component of the heating chair 100 using the carbon fiber heating element according to the inventive concept will be described as follows. First, the chair 110 constituting the inventive concept refers to a chair installed at a bus station or a subway platform and in a park. The chair 110 is installed at a bus station or in a park as shown in FIGS. 1 through 5 and has the mounting groove 114 of a predetermined depth on the upper surface of the seat 112.

The chair 110 configured as described above may be applied not only to a chair with a backrest, but also to a structure having only the seat 112 without a backrest. The mounting groove 114 for accommodating a heating element to be described later is formed to a predetermined depth on the upper surface of the seat 112 of the chair 110 according to the inventive concept.

Next, the thermal pad 120 constituting the inventive concept is designed to prevent heat loss through a lower side of the chair 110. The thermal pad 120 is mounted on and coupled to the mounting groove 114 of the seat 112 as shown in FIGS. 1 through 3.

The heating pad 120 described above is a material having a heat insulating effect and functions to prevent heat loss through a lower side of the seat 112 when the carbon fiber heating element 130 installed on the upper side of the heating pad 120 generates heat.

Next, the carbon fiber heating element 130 constituting the inventive concept is designed to heat the heating plate 140 by generating heat when supplied with power. The carbon fiber heating element 130 is installed on the upper side of the thermal pad 120 as shown in FIGS. 1 through 5 and, when supplied with power, generates heat to heat the heating plate 140 installed on the upper side of the carbon fiber heating element 130.

The carbon fiber heating element 130 described above is a conductive material having very high thermal conductivity and electrical conductivity. The carbon fiber heating element 130 can improve the heating effect and reduce electrical costs compared with a general electric heater. In the carbon fiber heating element 130, electrical flow and heat generation occurs. The carbon fiber heating element 130 is connected to a power source electrically and composed of many bundles of carbon fibers.

The carbon fiber heating element 130 is composed of bundles of several hundreds to tens of thousands of strands connected to the power source electrically. Here, the carbon fiber heating element 130 may have a planar or linear shape.

Carbon fibers constituting the carbon fiber heating element 130 described above are very thin fibers having carbon as their main component and having a thickness of 0.005 to 0.010 mm. Here, carbon atoms constituting a carbon fiber are bonded together in the form of hexagonal ring crystals along a longitudinal direction of the fiber. Due to this molecular arrangement structure, the carbon fiber has strong physical properties.

In addition, carbon fibers are high strength fibers that use a carbon atom crystal structure and are reinforced fibers that are most widely used for production of a composite material. Carbon fibers are classified into polyacrylonitrile (PAN)-based carbon fibers and pitch-based carbon fibers according to the precursor used to produce the carbon fibers. In particular, the PAN-based carbon fibers are widely used.

Of the carbon fibers described above, a PAN-based carbon fiber is a fiber in which imperfect crystals of graphite are arranged in an axial direction of the fiber. The fiber has a diameter of 5 to 10μ and is generally composed of several thousands to tens of thousands of bundles. In addition, the carbon fiber is soft and black and has a metallic luster. The carbon fiber is made by weaving PAN fibers (fibers used in yarn and blankets and usually called acrylic fibers).

In addition, in a pitch-based carbon fiber, pitch is a high boiling point component produced in the petrochemical industry or the coal tar industry. The pitch becomes a liquid crystal state at 350 to 500° C. when heated in an inert gas and then hardens into so-called coke. The pitch in the liquid crystal state is a mixture of condensed polycyclic, polynuclear aromatic molecules. When a pitch fiber obtained by melt-spinning the pitch in the liquid crystal state is heated in an oxidizing atmosphere, it changes into an insoluble, infusible fiber called an oxidative fiber.

The insoluble, infusible fiber changed into the oxidative fiber as described above is heated in an inert gas to an appropriate temperature of 1000° C. or higher to produce a carbon fiber. Since the aromatic molecules are arranged in layers in the liquid crystal state, the insoluble, infusible fiber is spun to arrange the aromatic molecules in parallel in the axial direction of the fiber and carbonized to produce a high-performance carbon fiber in which six-membered ring mesh planes of carbon are highly oriented.

The carbon fiber heating element 130 described above has high elasticity and high tensile strength (ten times the strength of iron and seven times the elasticity of iron), has a low thermal expansion rate (and is thus used in aerospace or munitions and vehicles), is lightweight and has good rigidity (weighs ¼ of iron because it has a far lower density than iron), is used as a conductive material with excellent thermoelectric conductivity (used as a carbon heating wire), is good in corrosion resistance and chemical resistance, and is excellent in fatigue resistance.

Next, the heating plate 140 constituting the inventive concept is heated by the carbon fiber heating element 130. As shown in FIGS. 1 through 5, the heating plate 140 is installed on the upper side of the carbon fiber heating element 130 and heated by the carbon fiber heating body 130.

The heating plate 140 described above is made of an aluminum plate, a stainless steel plate, or a copper plate. More preferably, a copper plate having good thermal conductivity may be used.

Since the heating plate 140 made of an aluminum plate, a stainless plate or a copper plate is installed on the upper side of the carbon fiber heating element 130 and heated by the carbon fiber heating element 130 as described above, it is always kept heated when power is supplied.

Next, the conductive cover plate 150 constituting the inventive concept is a portion to which the heat of the heating plate 140 is transmitted when a user sits. As shown in FIGS. 1 through 5, the conductive cover plate 150 covers the upper side of the heating plate 140 in a floating structure to form the thermal air layer 142 between the heating plate 140 and the conductive cover plate 150. When the weight of the user is put on the conductive cover plate 150, the conductive cover plate 150 is brought into surface contact with the heating plate 140 by the inner conductive cover plates 170 and heated by heat conduction.

In the above-described configuration, the thermal air layer 142 is sealed to elastically support the conductive cover plate 150 through the air cushion function. Since the thermal air layer 142 always keeps the conductive cover plate 150 heated through its heated air as described above, it can minimize the heat loss of the conductive cover plate 150, thereby reducing waste of power.

The conductive cover plate 150 described above is always heated to a predetermined temperature by the heated air of the thermal air layer 142 heated by the heating plate 130. Therefore, even if the conductive cover plate 150 loses heat depending on temperature conditions of the outside air, the heat loss is small.

In addition, in the technology of the inventive concept, the thermal air layer 142 is formed as a floating structure between the conductive cover plate 150 and the heating plate 140, and the air of the thermal air layer 142 is always kept heated by the heating plate 140 as described above. Thus, the heat loss of the heating plate 140 hardly occurs.

Therefore, in the technology according to the inventive concept, when the weight of a user is put on the heating chair 100, only a portion of each of the inner conductive cover plates 170 on which the weight is put is brought into surface contact with the heating plate 140 as shown in FIG. 4. Accordingly, the heat of the heating plate 140 is immediately conducted to the hip portion of the user through the inner conductive cover plates 170 and the conductive cover plate 150.

The conductive cover plate 150 described above includes a bending line 152 which slopes downward from a central portion toward both sides and is formed at a longitudinal center as shown in FIGS. 1 through 5. Here, the bending line 152 is formed to a predetermined length in both directions in the longitudinal direction as shown in FIG. 1.

Therefore, since the bending line 152 is formed at the longitudinal center as described above, when the longitudinal center as a top structure is pressed downward, the conductive cover plate 150 has the resilience to return upward. That is, when the weight of a user is put on the conductive cover plate 150 configured as described above, a lower surface of the conductive cover plate 150 is brought into surface contact with the heating plate 140. However, when the weight is removed from the conductive cover plate 150, the conductive cover plate 150 is restored to its original state by the resilience provided by the bending line 152 and the air cushion function of the thermal air layer 142.

Next, the finishing silicon 160 constituting the inventive concept seals the thermal air layer 142 between the heating plate 140 and the conductive covering plate 150 so that the thermal air layer 142 can function as an air cushion. As shown in FIGS. 1 through 3, the finishing silicon 160 closes the edges of the mounting groove 114 of the seat 112 to seal the thermal air layer 142.

In other words, the finishing silicon 160 described above fills a space between edge surfaces of the mounting groove 114 of the seat 112 and edge surfaces of the conductive cover plate 150 to seal the thermal air layer 142 between the heating plate 140 and the conductive cover plate 150 so that the thermal air layer 142 can function as an air cushion.

Next, the inner conductive cover plates 170 constituting the inventive concept are designed to horizontally divide the thermal air layer 142 between the heating plate 140 and the conductive cover plate 150 into multiple layers. The inner conductive cover plates 170 are installed in the thermal air layer 142 between the heating plate 140 and the conductive cover plate 150 to cover the upper side of the heating plate 140.

In other words, one or more inner conductive cover plates 170 of the inventive concept configured as described above are installed in the thermal air layer 142 between the heating plate 140 and the conductive cover plate 150 to cover the upper side of the heating plate 140 and to horizontally divide the thermal air layer 142.

As shown in FIGS. 1 through 3, two inner conductive cover plates 170 configured as described above may be installed in a floating structure in the thermal air layer 142 between the heating plate 140 and the conductive cover plate 150 and may horizontally divide the thermal air layer 142 between the heating plate 140 and the conductive cover plate 150 into three layers. Alternatively, one inner conductive cover plate 170 may be installed in the thermal air layer 142 to horizontally divide the thermal air layer 142 into two layers.

Since the inner conductive cover plates 170 configured as described above are installed between the heating plate 140 and the conductive cover plate 150, they are always kept heated by the heated air of the thermal air layer 142. Therefore, the air of the thermal air layer 142 is also kept heated by the inner conductive cover plates 170.

Since the inner conductive cover plates 170 installed between the heating plate 140 and the conductive cover plate 150 are always kept heated as described above, the internal heat loss of the thermal air layer 142 can be prevented.

Therefore, in the technology of the inventive concept in which the inner conductive cover plates 170 described above are formed, when the weight of a user is put on the heating chair 100, only a portion of each of the inner conductive cover plates 150 is brought into surface contact with the heating plate 140 by the conductive cover plate 150 on which the weight is put, as shown in FIG. 4. Accordingly, the heat of the heating plate 140 is immediately conducted to the hip portion of the user through the conductive cover plate 150 via the inner conductive cover plates 170.

In addition, each of the inner conductive cover plates 170 described above includes a bending line 172 which slopes downward from a central portion toward both sides and is formed at a longitudinal center as shown in FIGS. 1 and 3. Here, the bending line 172 is formed to a predetermined length in both directions in the longitudinal direction as shown in FIG. 1.

Since the bending line 172 is formed at the longitudinal center as described above, when the longitudinal center as a top structure is pressed downward, the inner conductive cover plates 170 have the resilience to return upward. That is, when the weight of a user is put on the conductive cover plate 150 disposed on the inner conductive cover plates 170 configured as described above, a lower surface of each of the inner conductive cover plates 170 is brought into surface contact with the heating plate 140 by the conductive cover plate 150. However, when the weight is removed from the conductive cover plate 150 as shown in FIG. 5, the inner conductive cover plates 150 are restored to their original state by the resilience provided by the bending line 172 and the air cushion function of the thermal air layer 142.

Figure 6:
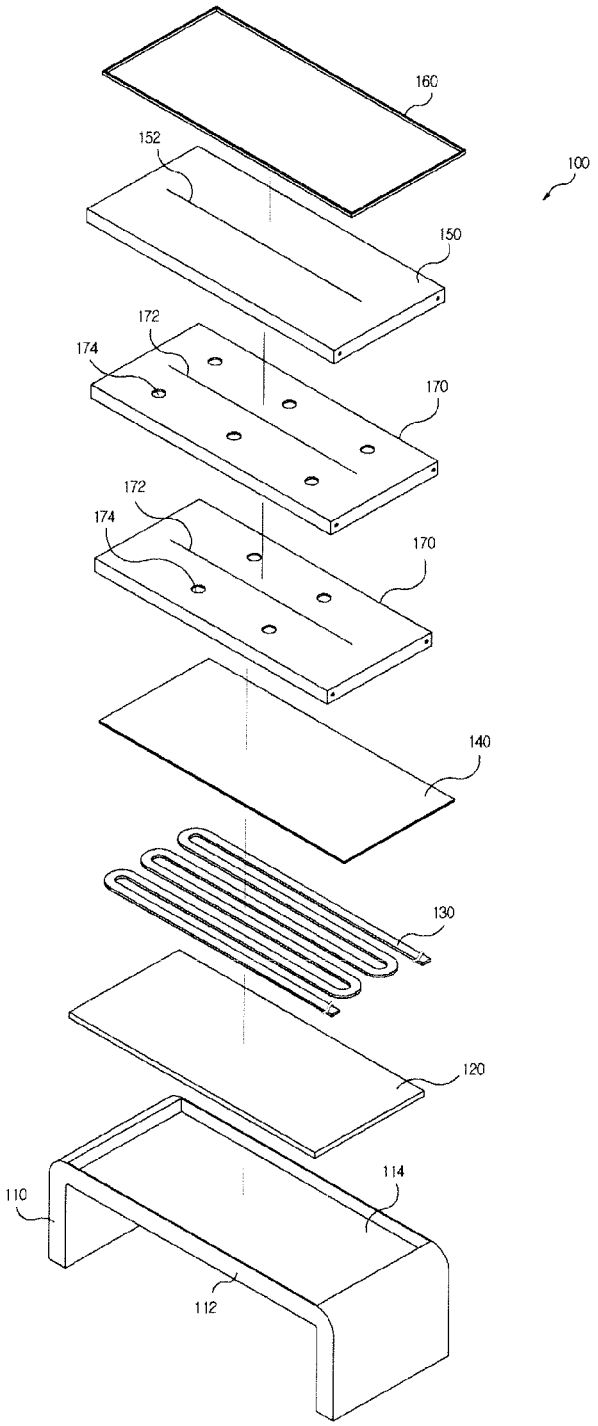
FIG. 6 is an exploded perspective view of another example of a heating chair using a carbon fiber heating element having a multi-layered thermal layer according to the inventive concept.
Figure 7:
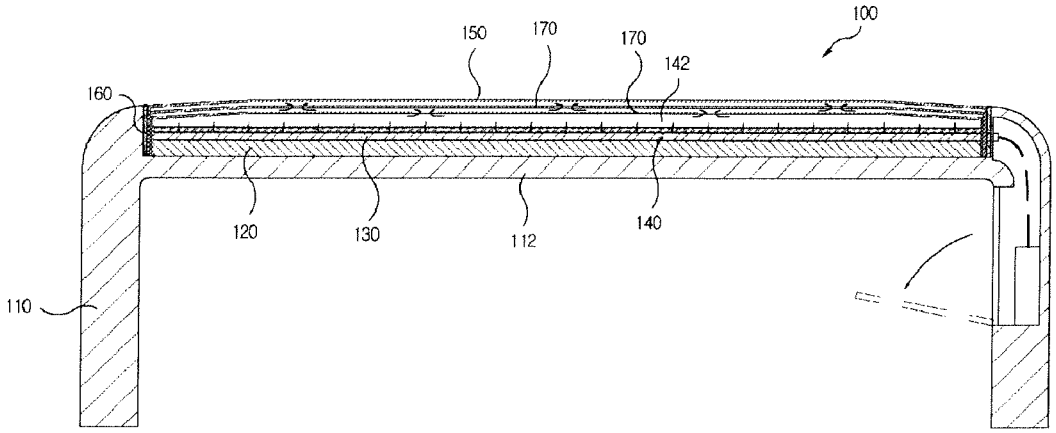
FIG. 7 is a front cross-sectional view of the heating chair of FIG. 6.
Figure 8:
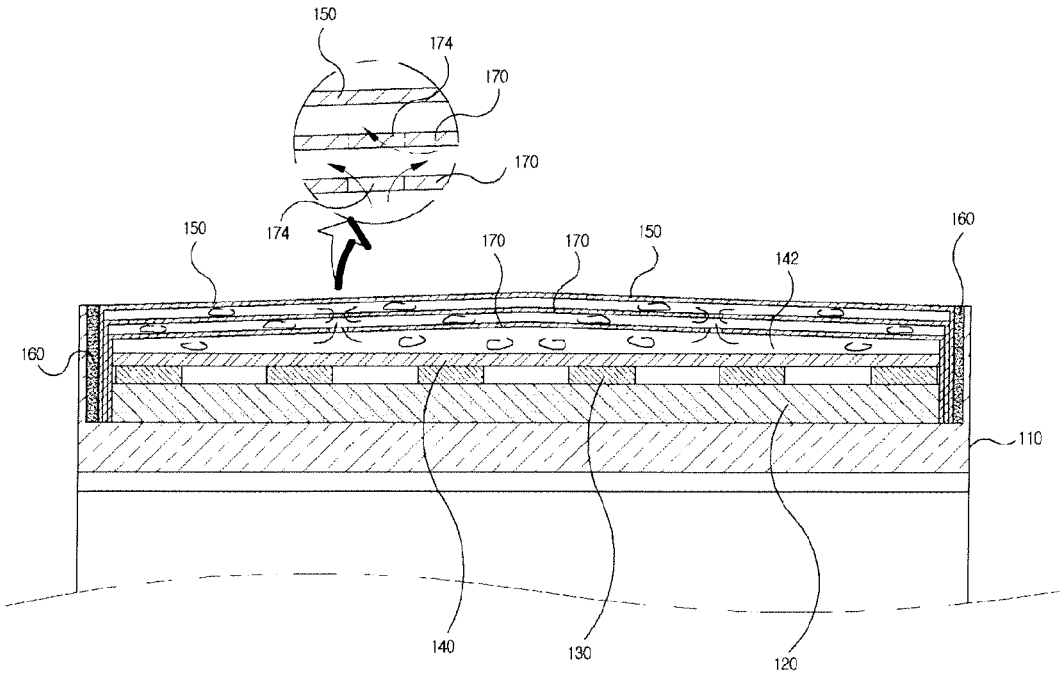
FIG. 8 is a side cross-sectional view of the heating chair of FIG. 6.
Figure 9:
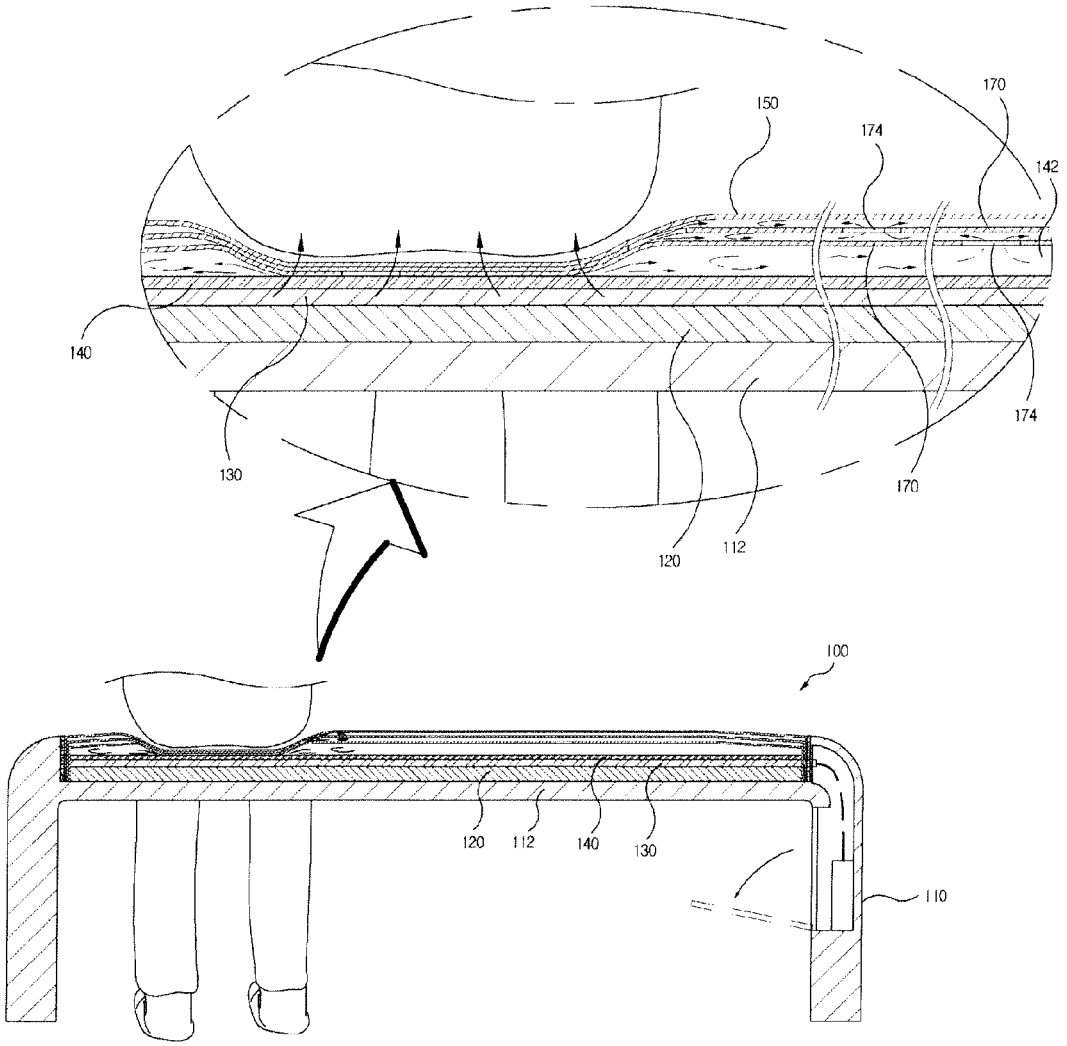
FIG. 9 is a front cross-sectional view showing an example of utilizing the heating chair of FIG. 6.

FIG. 6 is an exploded perspective view of another example of a heating chair using a carbon fiber heating element according to the inventive concept. FIG. 7 is a front cross-sectional view of the heating chair of FIG. 6. FIG. 8 is a side cross-sectional view of the heating chair of FIG. 6. FIG. 9 is a front cross-sectional view showing an example of utilizing the heating chair of FIG. 6.

Referring to FIGS. 6 through 9, the heating chair 100 according to the inventive concept may further include through holes 174 formed at regular intervals in each of one or more inner conductive cover plates 170 to vertically pass through each of the inner conductive cover plates 170. When the weight of a user is put on a conductive cover plate 150, air in a lower part of a thermal air layer 142 horizontally divided by the inner conductive cover plates 170 may move to an upper part of the thermal air layer 142 through the through holes 174. Therefore, the inner conductive cover plates 170 can be easily pressed.

In addition, when the weight of the user is removed from the conductive cover plate 150 as described above, the air in the upper part of the thermal air layer 142 is moved to the lower part of the thermal air layer 142 through the through holes 174 of the inner conductive cover plates 170 by the restoring force of the inner conductive cover plates 170.

As described above, in the technology according to the inventive concept, the heating chair 100 using a carbon fiber heating element has a structure in which the thermal air layer 142 divided into multiple layers by the inner conductive cover plates 170 is formed as a floating structure between the heating plate 140 and the conductive cover plate 150. This structure can reduce heat loss and thus save energy.

Therefore, the heating chair 100 using the carbon fiber heating element, which the thermal air layer 142 divided into multiple layers by the inner conductive cover plates 170 is formed as a floating structure between the heating plate 140 and the conductive cover plate 150, can be installed regardless of area and indoors or outdoors.

The inventive concept is not limited to the above-described embodiments, and various modifications can be made within the scope of the technical spirit of the inventive concept.

The invention claimed is:

1. A heating chair using a carbon fiber heating element having a multi-layered thermal layer, the heating chair comprising:

a chair which is installed at a bus station or a railway station or in a park and has a mounting groove of a predetermined depth on an upper surface of a seat;

a thermal pad which is mounted on the mounting groove of the seat;

the carbon fiber heating element which is installed on an upper surface of the thermal pad and generates heat when supplied with power;

a heating plate which is installed on an upper side of the carbon fiber heating element and heated by the carbon fiber heating element;

a conductive cover plate which covers an upper side of the heating plate in a floating structure to form a thermal air layer between the heating plate and the conductive cover plate;

a finishing silicon which closes edges of the mounting groove of the seat to seal the thermal air layer; and one or more inner conductive cover plates which are installed in the thermal air layer between the heating plate and the conductive cover plate to cover the upper side of the heating plate and to horizontally divide the thermal air layer into multiple layers, wherein through holes are further formed at regular intervals in each of the one or more inner conductive cover plates to vertically pass through each of the one or more inner conductive cover plates provided between the multiple layers of the thermal air layer, and the through holes provide air circulation between the multiple layers of the thermal air layer.

2. The heating chair of claim 1, wherein the carbon fiber heating element is a planar or linear heating element.

3. The heating chair of claim 1, wherein the thermal air layer is sealed by the finishing silicon to elastically support the conductive cover plate through an air cushion function.

4. The heating chair of claim 1, wherein each of the conductive cover plate and the inner conductive cover plates comprises a bending line which is formed to a predetermined length at a longitudinal center and slopes downward from a central portion toward both sides of the bending line.

5. The heating chair of claim 4, wherein a diagonal bending line is further formed from each corner of each of the conductive cover plate and the inner conductive cover plates to an end of the bending line.

* * * * *